US006305950B1

(12) United States Patent
Doorhy

(10) Patent No.: US 6,305,950 B1
(45) Date of Patent: Oct. 23, 2001

(54) LOW CROSSTALK MODULAR COMMUNICATION CONNECTOR

(75) Inventor: Michael V. Doorhy, Mokena, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 09/760,281

(22) Filed: Jan. 12, 2001

Related U.S. Application Data

(60) Provisional application No. 60/176,353, filed on Jan. 14, 2000.

(51) Int. Cl.[7] ..... H01R 9/09
(52) U.S. Cl. ..... 439/76.1
(58) Field of Search ..... 439/76.1, 620, 439/676, 941, 404, 405, 409, 417, 108, 101, 97, 638, 395, 441, 188

(56) References Cited

U.S. PATENT DOCUMENTS

| | | | | |
|---|---|---|---|---|
| 3,205,471 | * | 9/1965 | Herrmann | 439/176 |
| 4,153,325 | | 5/1979 | Asick . | |
| 4,274,691 | | 6/1981 | Abernethy et al. . | |
| 4,602,842 | * | 7/1986 | Free et al. | 439/156 R |
| 4,648,678 | | 3/1987 | Archer . | |
| 4,731,833 | | 3/1988 | Gumb et al. . | |
| 4,834,661 | * | 5/1989 | McMillian | 439/512 |
| 4,968,260 | | 11/1990 | Ingalsbe . | |
| 4,975,078 | | 12/1990 | Stroede et al. . | |
| 5,055,966 | | 10/1991 | Smith et al. . | |
| 5,061,209 | | 10/1991 | Bolick, Jr. et al. . | |
| 5,069,641 | | 12/1991 | Sakamoto et al. . | |
| 5,091,826 | | 2/1992 | Arnett et al. . | |
| 5,399,107 | | 3/1995 | Gentry et al. . | |
| 5,414,393 | | 5/1995 | Rose et al. . | |
| 5,488,201 | | 1/1996 | Liu . | |
| 5,586,914 | | 12/1996 | Foster, Jr. et al. . | |
| 5,599,209 | | 2/1997 | Belopolsky . | |
| 5,639,266 | | 6/1997 | Patel . | |
| 5,674,093 | | 10/1997 | Vaden . | |
| 5,700,167 | | 12/1997 | Pharney et al. . | |
| 5,704,797 | * | 1/1998 | Meyerhoefer et al. | 439/188 |
| 5,885,111 | * | 3/1999 | Yu | 439/676 |
| 5,938,479 | * | 8/1999 | Paulson et al. | 439/676 |
| 6,089,923 | * | 7/2000 | Phommachanh | 439/676 |
| 6,102,722 | * | 8/2000 | Arnett | 439/189 |
| 6,102,741 | | 8/2000 | Boutros et al. . | |
| 6,155,881 | * | 12/2000 | Arnett et al. | 439/676 |
| 6,176,642 | * | 1/2001 | Arnett et al. | 439/620 |
| 6,176,742 | * | 1/2001 | Arnett et al. | 439/620 |
| 6,183,306 | * | 2/2001 | Caveney | 439/676 |
| 6,244,906 | * | 6/2001 | Hashim et al. | 439/676 |

* cited by examiner

*Primary Examiner*—Gary Paumen
*Assistant Examiner*—Phuong Nguyen
(74) *Attorney, Agent, or Firm*—Robert A. McCann

(57) ABSTRACT

A modular communications connector including a housing defining a plug receiving opening, a conductor carrying sled including a printed circuit board designed in conjunction with a specific conductor design having two sets of contacts, one running under the printed circuit board and the other running over the top of the printed circuit board s to improve crosswalk performance. The connector further includes a wire containment fixture arrangement allowing for simplified field termination of the modular connector. The connector is assembled by loading the contacts and printed circuit board onto the sled which is snap fit into the housing, positioning wires through the wire containment fixture and slidably engaging the fixture to the sled to terminate the wires.

15 Claims, 9 Drawing Sheets

LOW CROSSTALK MODULAR COMMUNICATION CONNECTOR

Applicant claims, under 35 U.S.C. §119(e), the benefit of priority of the filing date of Jan. 14, 2000, of U.S. Provisional Patent Application Ser. No. 60/176,353, filed on the aforementioned date, the entire contents of which are incorporated herein by reference.

BACKGROUND OF THE INVENTION

1. Field of Invention

The present invention relates generally to modular communication connectors and more particularly to a modular communication connector having an improved contact arrangement designed to meet the increasing performance requirements of the communications industry in conjunction with increased data transfer rates.

2. Description of Related Art

In the communications industry, as data transmission rates have steadily increased, the industry has strived to provide electrical communication connectors that meet the needs to carry relatively high frequency signals while maintaining mechanical strength requirements and manufacturability. A wide variety of improvements have been made in the design of electrical connectors to reduce crosswalk effect occurring in parallel runs of closely spaced adjacent connectors. One example is co-pending U.S. Ser. No. 09/138,969 filed Aug. 24, 1998, which is commonly assigned to Panduit Corporation and incorporated herein by reference in its entirety. This type of connector uses a particular conductor configuration in conjunction with a multi-layered printed circuit board containing capacitors to achieve a reduction in the crosstalk effect. However, due to the high level of crosstalk occurring at the contact interface area for this connector at very high rates, the tuning effect achievable by the capacitors can still be difficult to accomplish. As such, further improvements in the art are still needed to address such problems and achieve higher levels of crosstalk suppression.

SUMMARY OF THE INVENTION

It is an object of the present invention to provide a modular communication connector with improved crosstalk performance.

It is another object of the present invention to provide an electrical communications connector having an improved contact design to reduce the effect of electrical crosstalk.

In general, a modular communications connector according to the invention includes a housing defining a plug receiving opening, a conductor carrying sled supporting first and second pluralities of conductors, and a wire containment fixture for terminating a communication cable having a plurality of individual communication wires. The first plurality of conductors includes first and second subsets of resilient contacts forming eight laterally spaced first conductors arranged in a telephone plug mating configuration. The first conductors may be associated with corresponding second conductors, preferably formed as insulation displacement contact (IDC) portions disposed extending rearwardly in a direction generally parallel to an axis of entry of the plug receiving opening. The IDC portions of the conductors are provided to terminate wire pairs of the communication cable and can be suitably arranged in upper and lower rows of four IDC portions. The connector also preferably uses a printed circuit board design incorporating capacitors which in conjunction with the conductor design improves the overall crosstalk performance.

The first subset of contacts are connected to the printed circuit board at first ends, extend from a bottom side of the printed circuit board towards and bend around a front end of the printed circuit board, and have second ends extending above the top surface of the printed circuit board to form plug contacting portions that are disposed within the plug receiving opening of the connector. The second subset of contacts are connected to the printed circuit board at first ends, extend from the top side of the printed circuit board toward the front end of the printed circuit board and then include a reverse bend ending in second ends that form plug contacting portions that extend above the top surface of the printed circuit board and are disposed within the plug receiving opening of the connector.

In a preferred embodiment, the second ends of the second subset of contacts extend in a generally parallel plane to the second ends of the first subset of contacts. By modifying the contacts in the jack/plug contact interface, the parallel runs of adjacent contacts in the communications connector can have improved crosstalk performance (i.e., reduced crosstalk between adjacent runs). In a firther preferred embodiment, the eight contacts are configured with the standard left to right numbering of contacts 1–8. These contacts are further arranged in two staggered rows, with contacts 2, 4 and 6 forming the second subset and all three being located in a rearward one of the two staggered rows. Contacts 1, 3, 5 and 7–8 form the first subset of contacts. Preferably, contact 8 is also provided in the rearward staggered row.

BRIEF DESCRIPTION OF THE DRAWINGS

The invention will be described with reference to the following drawings, wherein.

DETAILED DESCRIPTION OF PREFERRED EMBODIMENTS

Figure 1:
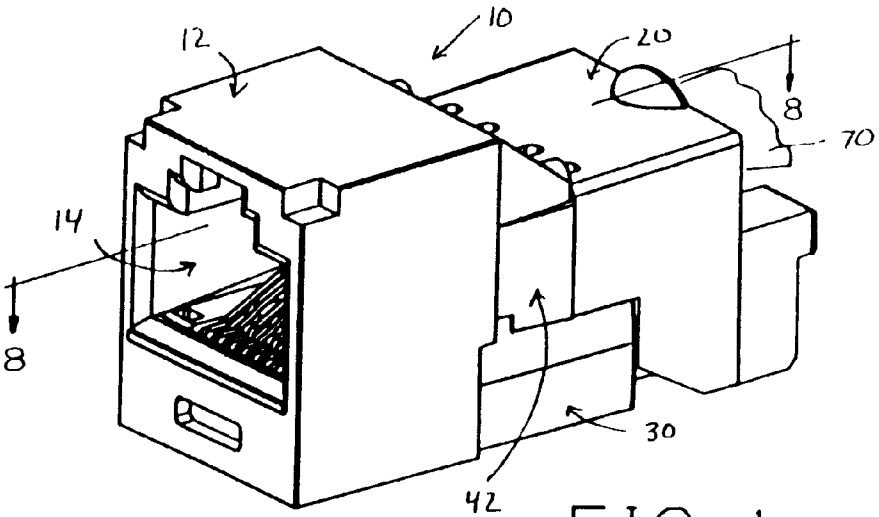
FIG. 1 is a front perspective view of a free standing modular communication connector embodying the concept of the present invention.
Figure 2:
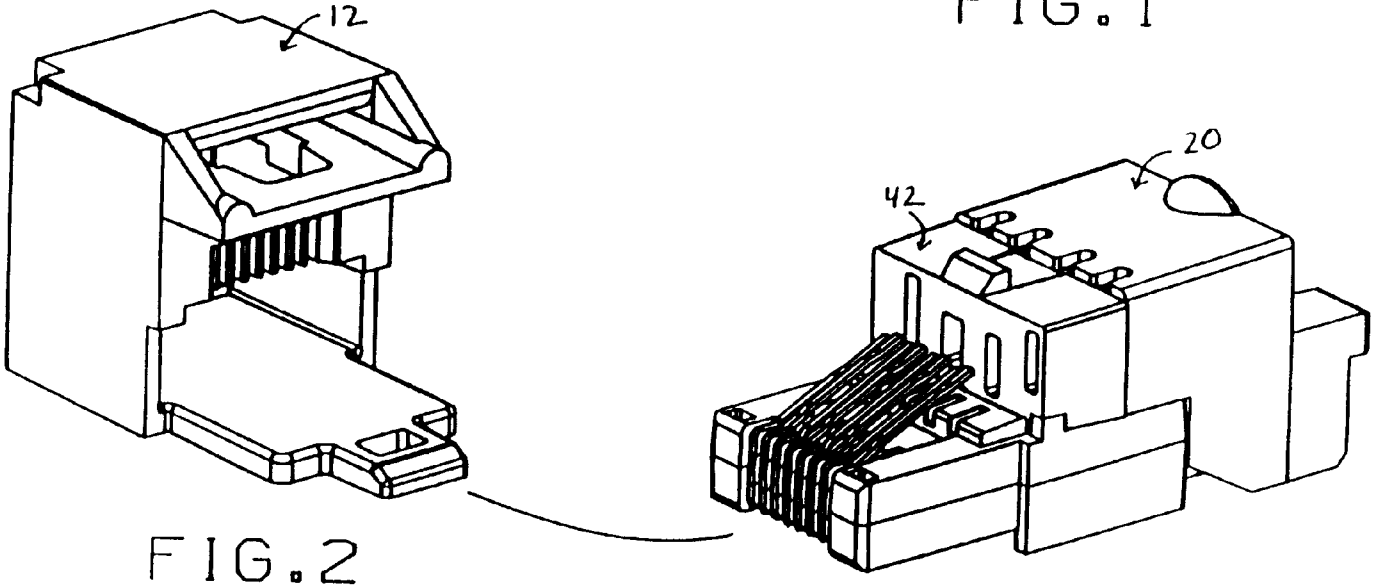
FIG. 2 is a partial exploded view of the connector of FIG. 1.

A modular communication connector embodying the concept of the present invention is designated generally by the reference numeral 10 in the accompanying drawings. As shown in FIGS. 1 and 2, connector 10 includes a housing 12 defining a plug receiving opening 14, a conductor carrying sled 30 and a wire containment fixture 20 for terminating a communication cable 70 having a plurality of individual communication wires. An IDC block 42 is also shown, which is used to aid in the manufacturing and assembly process.

Figure 3:
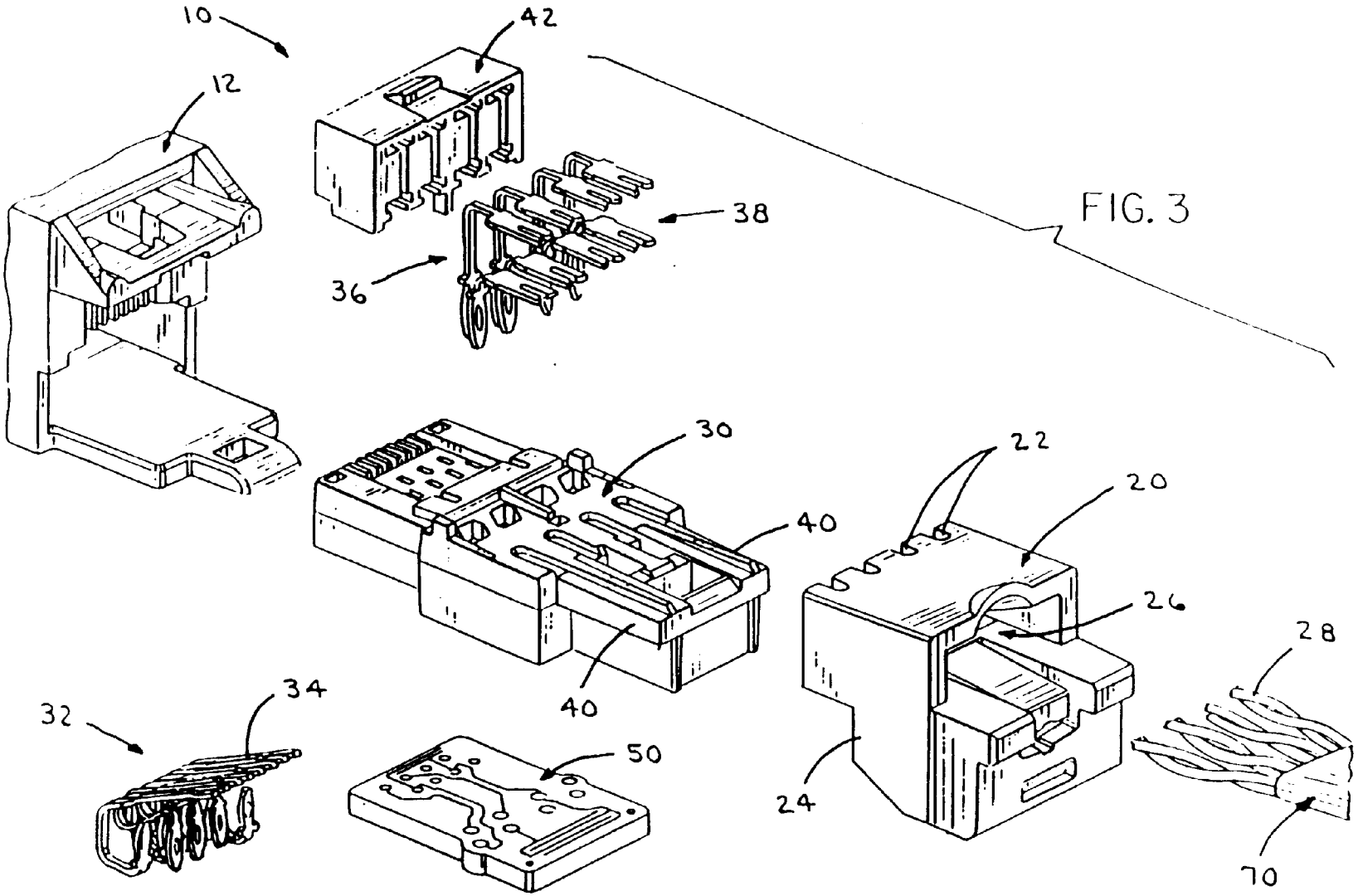
FIG. 3 is a rear perspective exploded view of the connector of FIG. 1 showing additional details according to an embodiment of the invention.
Figure 4:
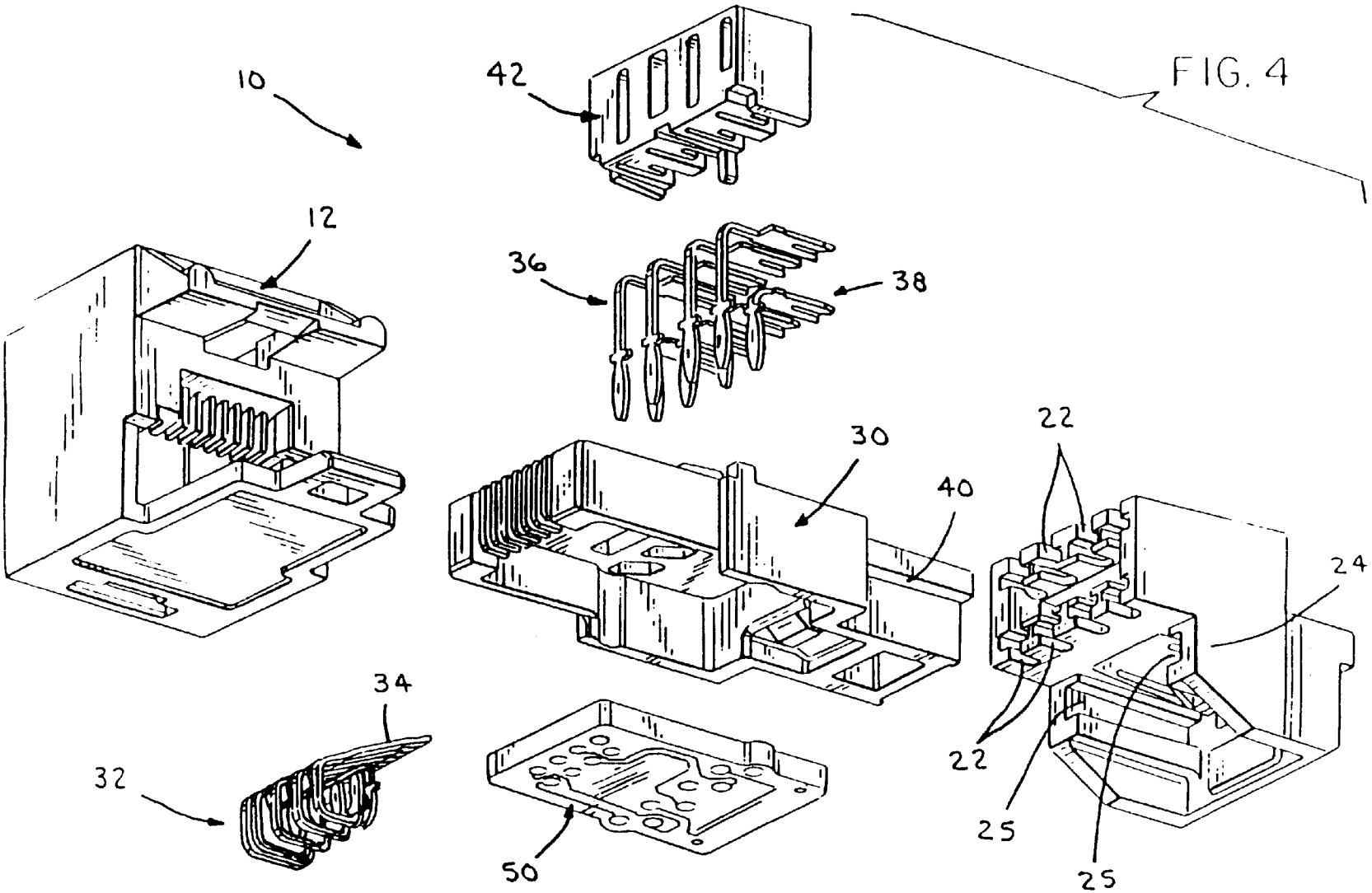
FIG. 4 is a bottom perspective exploded view of the connector of FIG. 1 showing additional details according to an embodiment of the invention.

As can be seen in FIGS. 3–4, connector 10 includes a conductor carrying sled 30 that supports a printed circuit board (PCB) 50 and a first and second plurality of conductors. The first plurality of conductors 32 each have a first end connected to the printed circuit board 50 and a second end forming a resilient contact portion 34 which is to be disposed within the plug receiving opening in accordance with a standard telephone plug mating configuration. The standards for the connector interface provides for eight laterally spaced conductors numbered 1–8, wherein the conductor pairs are defined by the associated wire pairs in accordance with the standard. Specifically, the standard pair arrangement provides for wires 4 and 5 comprising pair 1, wires 3 and 6 comprising pair 2, wires 1 and 2 comprising pair 3, and wires 7 and 8 comprising pair 4. As shown, each of the conductors 32 also includes a compliant pin at the first end so that the conductors 32 can be secured to the PCB 50 without requiring soldering.

Figure 5:
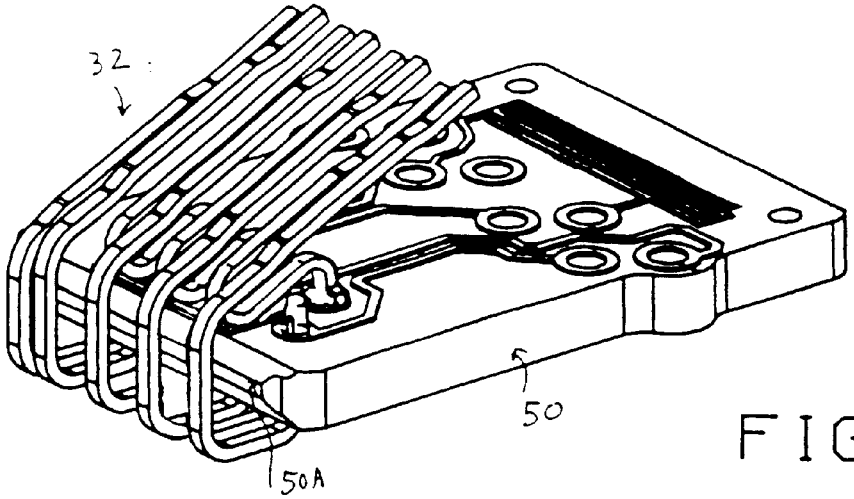
FIG. 5 is a top front perspective view of the contacts of the present invention engaged with a printed circuit board.
Figure 6:
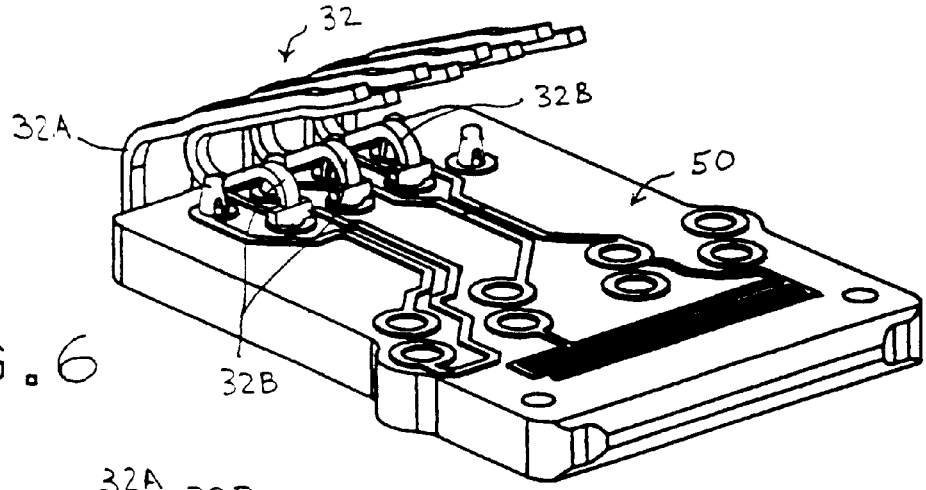
FIG. 6 is a top rear perspective view of the contacts of FIG. 5.
Figure 7:
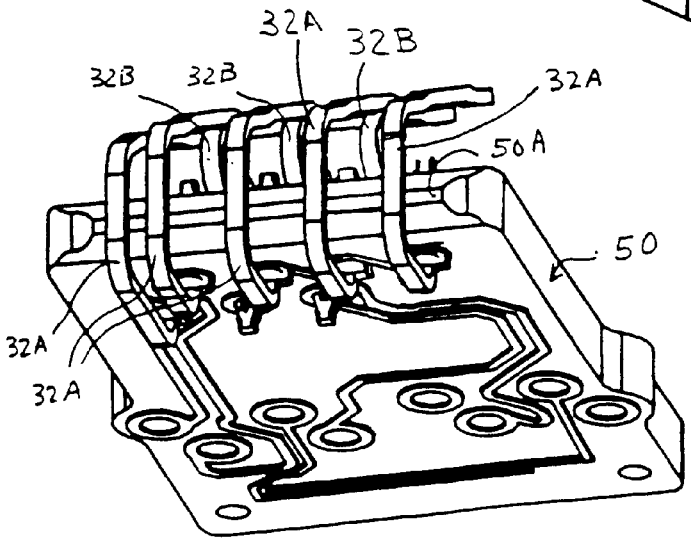
FIG. 7 is a bottom front perspective view of the contacts of FIG. 5.
Figure 8:
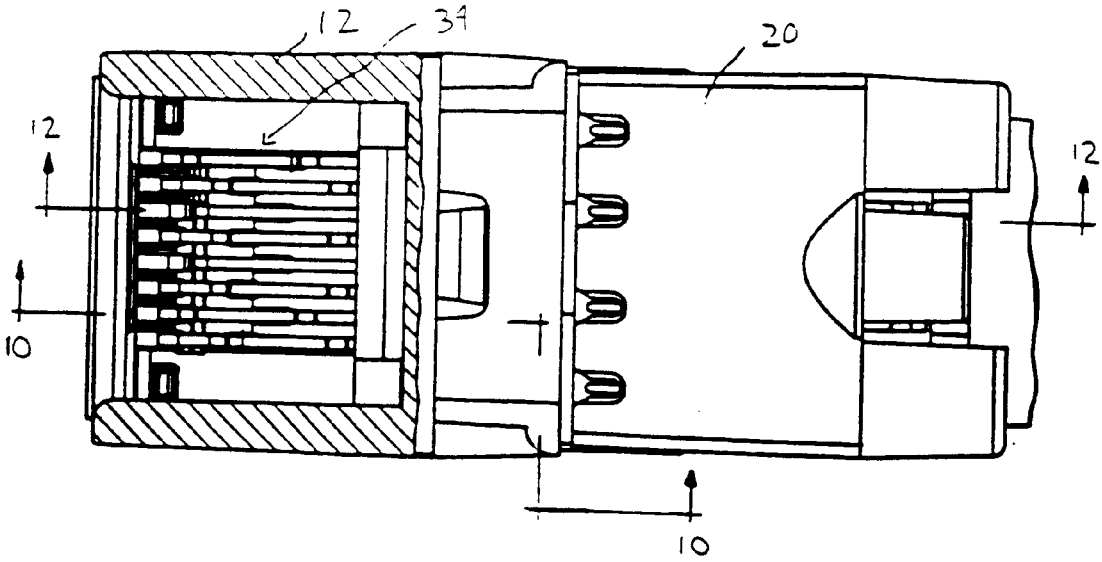
FIG. 8 is a partial fragmentary view of the electrical connector of FIG. 1 showing the contact interface region of the connector.
Figure 9:
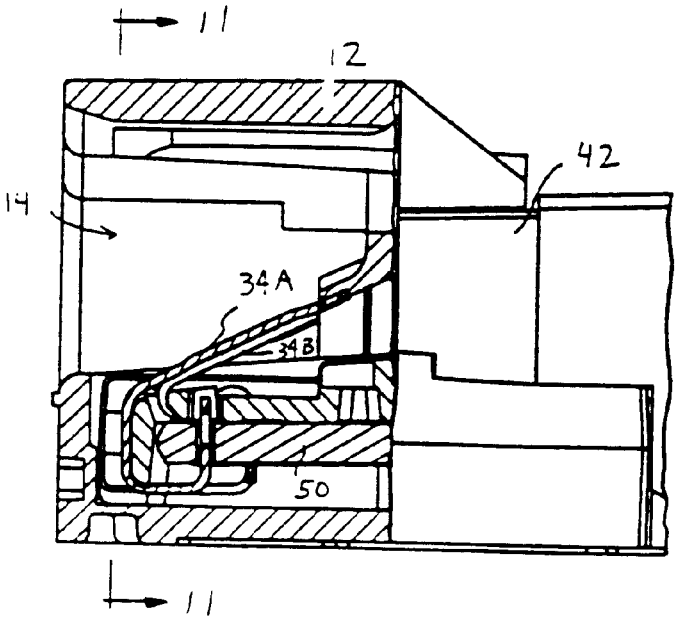
FIG. 9 is a sectional view taken along line 9—9 of FIG. 8.
Figure 10:
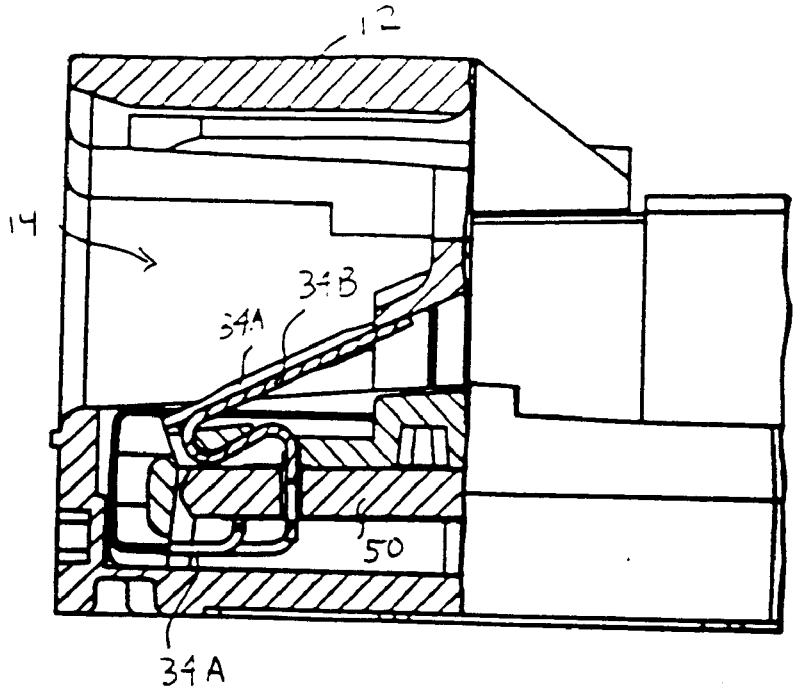
FIG. 10 is a sectional view taken along line 10—10 of FIG. 8.
Figure 11:
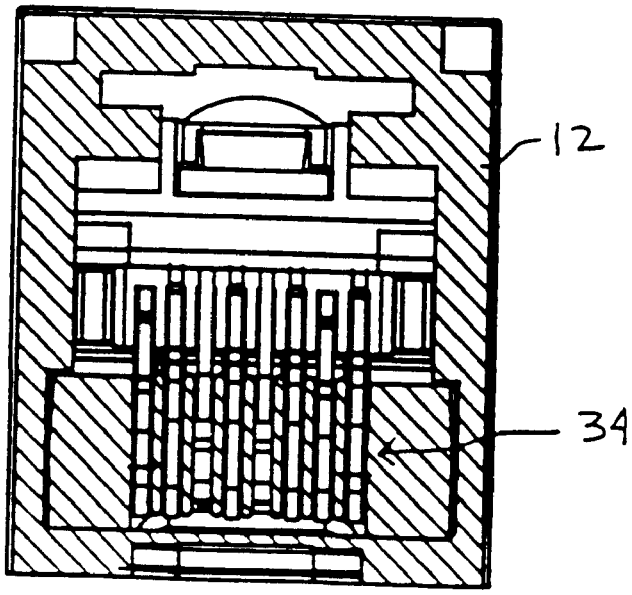
FIG. 11 is a sectional view taken along line 11—11 of FIG. 9.

The first plurality of conductors 32 are subdivided into first and second subsets of contacts 32A and 32B, which are better illustrated in FIGS. 5–7. The first subset 32A are connected to the printed circuit board 50 at a first end, extend from a bottom side of the printed circuit board 50 towards and bend around a front end 50A of the printed circuit board, and have second ends extending above the top surface of the printed circuit board to form plug contacting portions 34A that are disposed within the plug receiving opening 14 of connector 10. The second subset of contacts 32B are connected to the printed circuit board 50 at a first end, extend from the top side of the printed circuit board 50 toward the front end 50A of the printed circuit board and then include a reverse bend ending in second ends that form plug contacting portions 34B and extend above the top surface of the printed circuit board 50 and are disposed within the plug receiving opening 14 of connector 10.

The second plurality of conductors 36 each includes a compliant pin at one end for engagement with the PCB 50 and an IDC portion 38 at the second end. The second plurality of conductors 36 are configured such that the IDC portions 38 are disposed extending rearwardly in a direction generally parallel to an axis of entry of the plug receiving opening 14. The axis of entry is the generally horizontal direction in which a standard telephone plug type connector would be inserted in order to mate with the resilient contacts of the connector. The second plurality of conductors 36 are initially loaded into IDC block 42, which is used to aid in the manufacturing and assembly process. The IDC block 42 has locating pockets and a peg for accurate positioning on the sled 30. After assembling the PCB 50 and conductors 32, 36 in position on sled 30, the sled is inserted into the rear end of the housing such that resilient contact portions 34 of the first plurality of conductors 32 are disposed within the plug receiving opening 14 of housing 12 and the IDC portions 38 extend horizontally away from the back end in position for termination of individual wires 28 of cable 70 as shown and described later with respect to FIG. 13. Latches on the housing secure the sled in position.

As can be seen in FIGS. 3, 4, the wire containment fixture 20 has a cable opening 26 that allows both flat and round cable to be loaded into the wire containment fixture. The front end of wire containment fixture 20 includes eight individual vertically aligned wire slots 22. Thus as the twisted pair conductors of the cable are brought through the opening, the individual wires 28 can be routed into their respective wire slots 22. A label indicating the wiring scheme can be placed on the wire containment fixture 20 for providing the user instructions. Engagement walls 24 including guide slots 25 can be provided on fixture 20 beneath the wire slots 22 and are formed to engage with a pair of guide rails 40 disposed on each lateral edge of the rearward end of sled 30 to allow for sliding movement of fixture 20 along sled 30 and to provide for proper wire location during termination.

In general, in communications connectors, some crosstalk effect is occurring at every portion along adjacent conductors of the connector. That is, crosstalk occurs between adjacent conductors at the resilient contact portions of the plug mating end, between adjacent contacts on the PCB, as well as between adjacent IDC portions. In the preferred embodiment shown, the overall crosstalk performance of the connector is enhanced through a combination of minimizing crosstalk interaction between adjacent conductors where possible and using capacitors on a PCB design to balance the overall remaining crosstalk. Additional reductions are achieved by the specific contact interface described in FIGS. 5–7.

Referring to FIGS. 5–7, the contacts 32 are preferably provided with the first ends being arranged and affixed in two staggered and offset rows, with odd contacts being in a forwardmost row and the even contacts being in a rearwardmost row. The first subset of contacts 32A are connected to printed circuit board 50 at a first end, extend from a bottom side of printed circuit board 50 towards and bend around a front end 50A of printed circuit board 50, and have second ends extending above the top surface of the printed circuit board to form plug contacting portions 34A that are disposed within the plug receiving opening of the connector. The second subset of contacts 32B are connected to printed circuit board 50 at a first end, extend from the top side of printed circuit board 50 toward the front end 50A and then include a reverse bend ending in second ends that form plug contacting portions 34B that extend above the top surface of the printed circuit board and are disposed within the plug receiving opening of the connector.

In a preferred embodiment, the second ends of the second subset of contacts 32B extend in a generally parallel plane to the second ends of the first subset of contacts 32A. By modifying the contacts in the jack/plug contact interface as described, the parallel runs of adjacent contacts in the communications connector can have improved crosstalk performance (i.e., reduced crosstalk between adjacent runs). In a more preferred embodiment, the eight contacts are configured with the standard left to right numbering of contacts 1–8. In this embodiment exemplified by FIGS. 5–7, individual contacts 2, 4 and 6 form the second plurality of contacts 32B and are all located in a rearward one of the two staggered rows. Individual contacts 1, 3, 5 and 7–8 form the first plurality of contacts 32A, with individual contacts 2 and 8 also being provided in the rearward staggered row.

FIGS. 8–11 show additional views illustrating the inventive contact configuration, which improves crosstalk reduction by modifying the jack/plug contact interface. Besides the improved crosstalk properties, the inventive contact configuration also achieves improves mechanical strength. That is, by the design of contacts 32B forming the second plurality of contacts (such as individual contacts 4 and 6) to extend above the PCB 50 from the rearwardmost contact row, a longer beam length can be provided, which decreases the stresses in the contact when a plug is fully inserted into the connector, which helps prevent permanent deformation.

Figure 12:
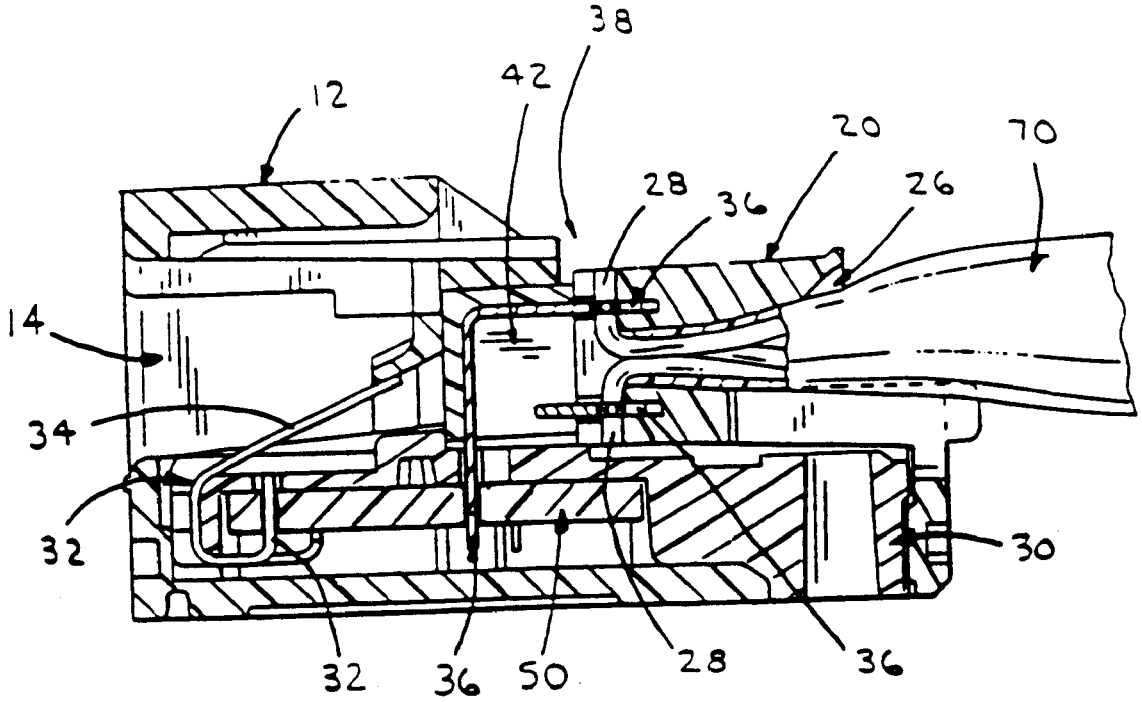
FIG. 12 is a side cross-sectional view of the connector of FIG. 1.
Figure 13:
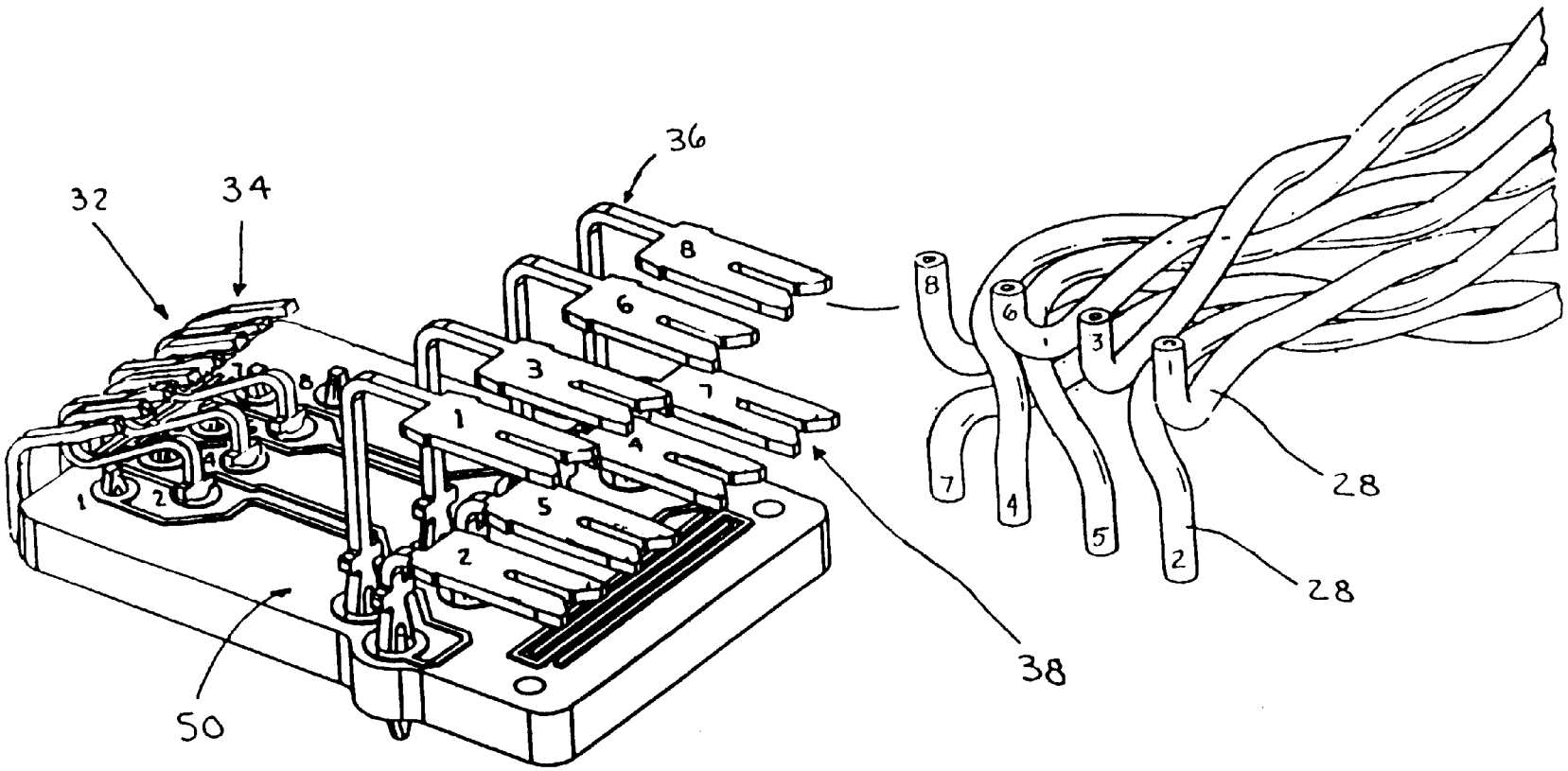
FIG. 13 is a perspective view showing termination of twisted wire pairs in respective IDCs in the PCB, which is shown without the wire containment fixture, housing, sled and IDC block for simplification.

Full assembly of the communications connector will now be described with respect to FIGS. 12–13. The IDC portions 38 of the second plurality of conductors 36 for terminating pairs of wires 28 of the communication cable are preferably arranged in two rows of four IDC portions. The contacts are configured such that the top and-bottom IDC portion at each end of the rows terminates a wire pair and the two internal IDC portions of each row terminate a wire pair. Specifically, as previously discussed the standard pair arrangement for twisted pair wires is wires 4 and 5 are pair 1, wires 3 and 6 are pair 2, wires 1 and 2 are pair 3 and wires 7 and 8 are pair 4. The standard in the industry sets forth that the odd wires are the tip and the even wires are the ring of the pair. As shown, pair 3 comprising contacts 1 and 2 and pair 4 comprising contacts 7 and 8 are disposed respectively at the left and right ends of the two rows of IDC portions. Pair 2 comprising contacts 3 and 6 is disposed on the upper row at the two internal IDC portions and pair 1 comprising contacts 4 and 5 is disposed in the bottom row within the two inner IDC portions. This specific IDC arrangement improves crosstalk performance by minimizing any additional undesired crosstalk while helping to balance existing crosstalk effects found in the plug and jack contact arrangement. Furthermore, this IDC layout allows for pairs to remain twisted as close to the IDC's as possible which helps decrease the crosstalk needed to be balanced in the connector. Thus, the IDC arrangement allows for a simplified PCB capacitor design.

Figure 16:
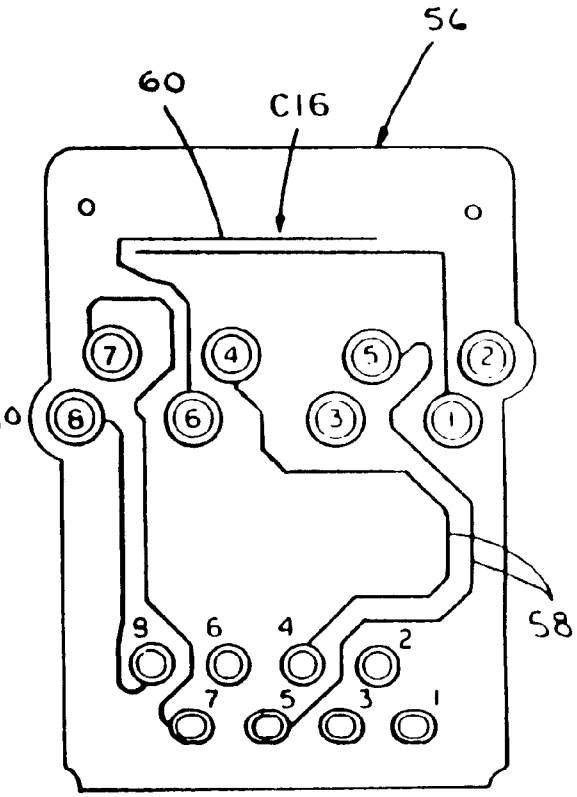
FIG. 16 is a plan view of the bottom layer of the printed circuit board.
Figure 15:
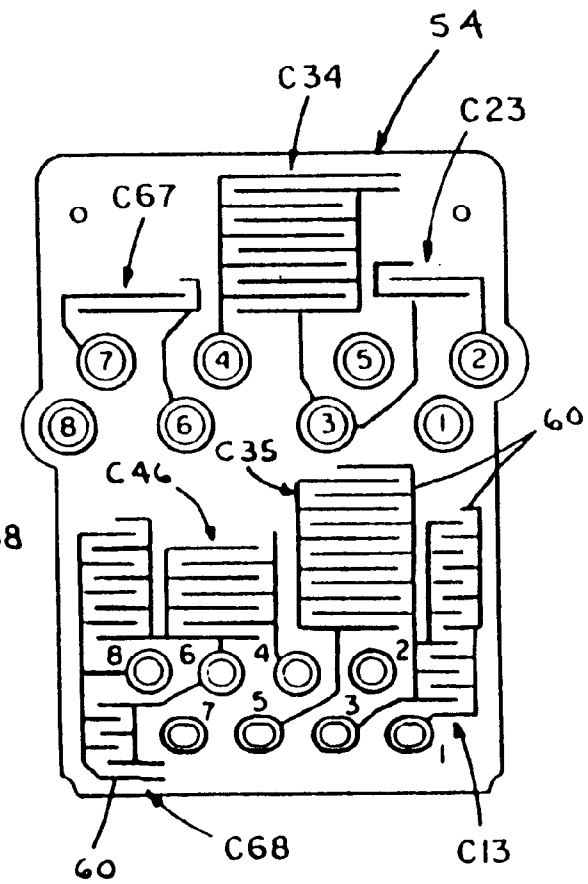
FIG. 15 is a plan view of the second layer which is identical to the third layer of the printed circuit board.
Figure 14:
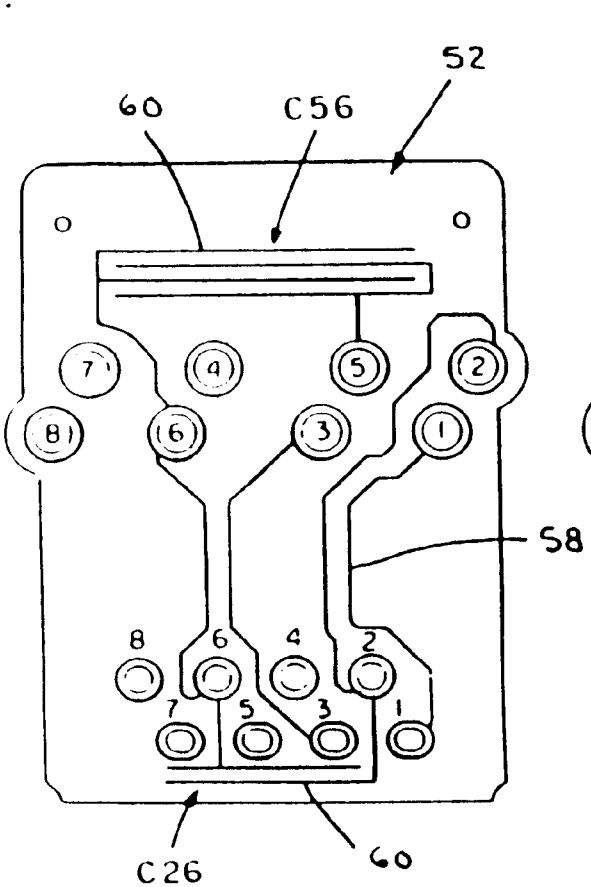
FIG. 14 is a plan view of the top layer of the circuit board.

To further assist in crosstalk reduction, the first and second plurality of conductors 32, 36 are connected through printed circuit board 50, which has a specific circuit to assist in crosstalk reduction and/or balance. As can be seen in FIGS. 14–16, the printed circuit board 50 may be a four layer board with a plurality of through holes formed through all four layers, each of which corresponds respectively with one of the compliant pin ends of one of the first or second plurality of conductors 32, 36. The top 52 and bottom 56 outer layers contain traces 58 for interconnecting the first and second plurality of conductors 32, 36 via their respective conductive through holes. The two inner layers 54 are identical to each other and is shown only once in FIG. 15. Seven of the ten capacitors 60 which are utilized in the exemplary design for crosstalk reduction are housed in the middle two layers 54. The outer layers 52, 56 also include three capacitors 60 which in the preferred design were not placed in the middle layers 54 due to space and capacitor layout constraints.

As can be seen, the conductor traces 58 within a pair are of relatively the same length and run nearby each other to obtain a proper impedance for return/loss performance and to reduce possible far end crosstalk (FEXT) effect. It is to be noted that the thickness of the traces can also be adjusted to achieve a desired impedance. Additionally, certain contact pairs have the traces 58 run on opposite sides of the board to minimize near end crosstalk (NEXT) in that area. For example, traces 4 and 5, and 7 and 8 for pairs 1 and 4 respectively are disposed on the bottom board, whereas traces 3 and 6, and 1 and 2 for pairs 2 and 3 respectively are disposed on the top board. However, other various PCB configurations are contemplated.

Capacitance is added to the PCB in order to compensate for the crosstalk which occurs between adjacent conductors of different pairs throughout the connector arrangement. The capacitance can be added in several ways. The capacitance can be added as chips to the board or can be integrated into the board using pads or finger capacitors.

In a preferred embodiment shown, capacitors are added in the form of finger or interdigitated capacitors connected to conductor pairs. The capacitors are identified by the conductor to which they are connected and to which capacitance is added to balance the crosstalk effect seen by the other conductor of a pair. For example, C46 identifies the finger capacitor connected to conductors 4 and 6 to balance the crosstalk seen between conductors 4 and 6 with the crosstalk seen between conductors 5 and 6 throughout the connector.

In the field, the preassembled housing 12 and sled 30 containing the printed circuit board 50, first plurality of contacts 32, second plurality of contacts 36 and IDC block 42 is provided such that the plug mating resilient contact portions 34 are disposed within the plug receiving opening 14 and the IDC portions 38 are horizontally disposed for accepting the individual wires 28. The communication cable 70 is inserted into the opening 26 of the wire containment fixture 20, the individual wires 28 are inserted into the respective wire slots 22 and the excess wire cut off. Finally, the wire containment 20 having the engagement walls 24 with guide slots 25 is assembled onto sled 30 via the guide rails 40 and slid forward until proper termination is achieved and locked in position by a cantilevered snap latch.

While the inventive contact configuration has been shown in conjunction with a specific exemplary communication connector, the novel aspects of the invention can be used with a variety of different electrical connectors. Moreover, while a preferred embodiment modifies only individual contacts 2, 4 and 6, it is possible to modify different combinations of contacts for different electrical connector or printed circuit board arrangements to achieve improvements in performance. Thus, while the particular preferred embodiments of the present invention have been shown and described, it will be obvious to those skilled in the art that changes and modifications may be made without departing from the teachings of this invention and that the matter set forth in the foregoing description and accompanying drawings is offered by way of illustration only and not as a limitation. The actual scope of the invention is intended to be defined in the following claims when viewed in their proper perspective based on the prior art.

What is claimed is:

1. A modular communications connector including:

a housing defining a plug receiving opening;

a printed circuit board having traces thereon;

a first plurality of conductors each having a portion arranged in accordance with a standard telephone wiring configuration, the first plurality of conductors being subdivided into a first subset of contacts and a second subset of contacts; and a second plurality of conductors that terminate pairs of wires of a communication cable at a first end and have a second end interconnected to a corresponding one of the first plurality of conductors through the printed circuit board, wherein the first subset of contacts are connected to the printed circuit board at first ends, extend from a bottom side of the printed circuit board towards and bend around a front end of the printed circuit board, and have second ends extending above a top surface of the printed circuit board to form plug contacting portions that are disposed within the plug receiving opening of the connector and the second subset of contacts are connected to the printed circuit board at first ends, extend from the top side of the printed circuit board toward the front end of the printed circuit board and then include a reverse bend ending in second ends that form plug contacting portions extending above the top surface of the printed circuit board and disposed within the plug receiving opening of the connector.

2. The modular communications connector of claim 1, wherein the first end of the second plurality of conductors include IDC portions arranged in an upper and a lower row of four IDC portions each such that the top and bottom IDC portion at each end of the rows terminates an associated wire pair and the two internal IDC portions of each row terminating an associated wire pair.

3. The modular communications connector according to claim 1, wherein the printed circuit board includes at least three layers, with the outer layers containing the traces for interconnecting the first and second plurality of conductors and the inner layer is formed with capacitors to affect crosstalk performance of the connector.

4. The modular communications connector according to claim 1, wherein the second ends of the second subset of contacts extend in a generally parallel plane to the second ends of the first subset of contacts.

5. The modular communications connector according to claim 1, wherein the first ends of the first and second subsets of contacts are arranged and affixed in two staggered and offset rows, with odd contacts being in a forwardmost row and even contacts being in a rearwardmost row.

6. The modular communications connector according to claim 1, wherein there are eight total contacts, sequentially aligned as contacts 1–8, with contacts 2, 4 and 6 forming the second subset of contacts and contacts 1, 3, 5, 7 and 8 forming the first subset of contacts.

7. The modular communications connector according to claim 6, wherein the first ends of the first and second subsets of contacts are arranged and affixed in two staggered and offset rows, with odd contacts being in a forwardmost row and even contacts being in a rearwardmost row.

8. The modular communications connector according to claim 7, wherein the second subset of contacts are located in the rearwardmost row and at least some of the first subset of contacts are located in the forwardmost row.

9. A modular communications connector including a housing defining a plug receiving opening having a first plurality of conductors each arranged in accordance with a telephone wiring configuration and a second portion adapted to be connected to a printed circuit board, and a second plurality of conductors having insulation displacement contact (IDC) portions that terminate wires of a communication cable and a second portion adapted to be connected to a printed circuit board, comprising:

a printed circuit board (PCB) engageable with both the first and second plurality of conductors having at least three layers with a pair of outer layers containing a plurality of traces that interconnect individual ones of the first plurality of conductors with a corresponding one of the second plurality of conductors to complete an electrical signal path between the IDC of the corresponding one second plurality of conductors and the first end portion of the corresponding one of the first plurality of conductors; and capacitors formed on an inner layer of the PCB for affecting crosstalk performance of the connector, wherein the first plurality of contacts are subdivided into first and second subsets, the first subset of contacts are connected to the printed circuit board at first ends, extend from a bottom side of the printed circuit board towards and bend around a front end of the printed circuit board, and have second ends extending above a top surface of the printed circuit board to form plug contacting portions that are disposed within the plug receiving opening of the connector, and the second subset of contacts are connected to the printed circuit board at first ends, extend from the top side of the printed circuit board toward the front end of the printed circuit board and then include a reverse bend ending in second ends that form plug contacting portions extending above the top surface of the printed circuit board and disposed within the plug receiving opening of the connector.

10. The modular communications connector of claim 9, wherein the IDC portions are arranged in an upper and a lower row of four IDC portions such that the top and bottom IDC portion at each end of the rows terminates an associated wire pair and the two internal IDC portions of each row terminating an associated wire pair.

11. The modular communications connector according to claim 9, wherein the second ends of the second subset of contacts extend in a generally parallel plane to the second ends of the first subset of contacts.

12. The modular communications connector according to claim 9, wherein the first ends of the first and second subsets of contacts are arranged and affixed in two staggered and offset rows, with odd contacts being in a forwardmost row and even contacts being in a rearwardmost row.

13. The modular communications connector according to claim 9, wherein there are eight total contacts, sequentially aligned as contacts 1–8, with contacts 2, 4 and 6 forming the second subset of contacts and contacts 1, 3, 5, 7 and 8 forming the first subset of contacts.

14. The modular communications connector according to claim 13, wherein the first ends of the first and second subsets of contacts are arranged and affixed in two staggered and offset rows, with odd contacts being in a forwardmost row and even contacts being in a rearwardmost row.

15. The modular communications connector according to claim 14, wherein the second subset of contacts are located in the rearwardmost row and at least some of the first subset of contacts are located in the forwardmost row.

* * * * *